US011480989B2

(12) United States Patent
Liu et al.

(10) Patent No.: US 11,480,989 B2
(45) Date of Patent: Oct. 25, 2022

(54) HIGH ACCURACY ZENER BASED VOLTAGE REFERENCE CIRCUIT

(71) Applicant: NXP USA, Inc., Austin, TX (US)

(72) Inventors: Hongwei Liu, Toulouse (FR); Yuan Gao, Cugnaux (FR); Estelle Huynh, Villeneuve-Tolosane (FR)

(73) Assignee: NXP USA, Inc., Austin, TX (US)

( * ) Notice: Subject to any disclaimer, the term of this patent is extended or adjusted under 35 U.S.C. 154(b) by 12 days.

(21) Appl. No.: 17/322,175

(22) Filed: May 17, 2021

(65) Prior Publication Data

US 2021/0389791 A1 Dec. 16, 2021

(30) Foreign Application Priority Data

Jun. 16, 2020 (EP) ..... 20305656

(51) Int. Cl.
*G05F 3/18* (2006.01)

(52) U.S. Cl.
CPC ..... *G05F 3/185* (2013.01)

(58) Field of Classification Search
CPC ... G05F 3/16; G05F 3/18; G05F 3/185; G05F 3/22; G05F 3/222; G05F 3/225; G05F 3/30
See application file for complete search history.

(56) References Cited

U.S. PATENT DOCUMENTS 4,560,919 A 12/1985 Ishikawa et al.
6,456,151 B1 * 9/2002 Pontarollo ..... H02M 3/07 327/198
2004/0056645 A1 * 3/2004 Inagaki ..... G05F 3/242 323/313
2015/0177771 A1 6/2015 Marinca
2016/0197095 A1 7/2016 Yamane et al.
2020/0218302 A1 * 7/2020 Brule ..... G05F 3/18

FOREIGN PATENT DOCUMENTS

EP 3553625 A1 10/2019
JP S59195719 A 11/1984

OTHER PUBLICATIONS

Popa, Cosmin Radu, "Superior-Order Curvature-Correction Techniques for Voltage References", Springer Science+Business Media, 2009, pp. 102-108.

* cited by examiner

*Primary Examiner* — Nguyen Tran

(57) ABSTRACT

A voltage reference circuit is disclosed comprising: a supply terminal; a ground terminal; a first current source and a Zener diode connected in series between the supply and ground terminals and having a first node therebetween and configured to supply a Zener voltage at the first node; an output node configured to provide a voltage reference; and a CTAT, circuit connected between the first node and the output node; wherein the CTAT circuit comprises: two bipolar transistors, having their respective emitters connected at a second node, and configured to, in operation, have equal collector-emitter currents, the base of the first bipolar transistor being connected to the first node, the base of the second bipolar transistor being connected to a centre node of a first voltage divider; and wherein the first voltage divider is connected between the emitter of the second bipolar transistor and the output node.

20 Claims, 4 Drawing Sheets

HIGH ACCURACY ZENER BASED VOLTAGE REFERENCE CIRCUIT

FIELD

The present disclosure relates to voltage reference circuits, and in particular to temperature compensated Zener based voltage reference circuits.

BACKGROUND

For many electronic applications, it is necessary to provide an accurate, known, fixed reference voltage. The requirements for such a reference voltage depend on the type of application. For example battery management system (BMS) products typically require a reference voltage which is relatively insensitive to changes in the ambient or operating temperature, and remains stable over a long period of time—typically measured in years. That is to say the reference voltage must have a low drift. Drift may be caused by an ageing of the components, or by stress on an IC package for instance.

Conventionally, bandgap circuits are used to provide a known reference voltage. However, for applications such as BMS products where long-term drift is a key performance requirement, reference voltage circuits based on a Zener diode are an attractive alternative. The voltage across Zener a diode varies only slowly with the current through the diode, and thus the diode can form the basis of an accurate reference voltage. However, Zener diodes generally have a positive temperature coefficient (TC), that is to say for a fixed current, the voltage across the diode increases with increasing temperature, and thus temperature compensation is required by adding a circuit which is complementary to absolute temperature (CTAT)

SUMMARY

According to a first aspect of the present disclosure there is provided a voltage reference circuit comprising: a supply terminal configured to be connected to a supply voltage; a ground terminal configured to be connected to a ground voltage; a first current source and a Zener diode connected in series between the supply terminal and the ground terminal and having a first node therebetween and configured to supply a Zener voltage at the first node (Vz); an output node (Vref_hv) configured to provide a voltage reference (Vref_hv, Vref); and a complementary to absolute temperature, CTAT, circuit connected between the first node and the output node; wherein the CTAT circuit comprises: a first bipolar transistor (Q1) and a second bipolar transistor (Q2), each having a base, a collector and an emitter, having their respective emitters connected at a second node (Vs), and configured to, in operation, have equal collector-emitter currents, wherein the base of the first bipolar transistor is connected to the first node and the base of the second bipolar transistor is connected to a centre node of a first voltage divider, and wherein the first voltage divider consists of a first resistance connected between the output node (Vref_hv) and the centre node and a second resistance connected between the centre node and the emitter of the second bipolar transistor.

By thus providing a pair of bipolar transistors arranged to carry identical or nearly identical currents, their base emitter voltages may thereby be accurately matched, which may improve the accuracy of the cancellation of the positive temperature coefficient of the Zener diode voltage. Moreover, since the transistors are not stacked or partially stacked relative to a ground voltage, the minimum supply voltage required supply terminal for proper operation may be lower than in known circuits.

In one or more embodiments the CTAT circuit further comprises a second current source (I_BIAS_hs), connected between the collector of the first bipolar transistor and the supply node, and configured to provide a bias current to the first bipolar transistor.

In one or more embodiments the CTAT circuit further comprises a FET having main terminals connected between the collector of the second bipolar transistor and the supply node, and a control terminal connected to the collector of the first bipolar transistor, and configured to match the collector-emitter currents through the first and second bipolar transistors. This arrangement may provide a particularly simple method of ensuring matched currents.

In one or more embodiments the CTAT circuit further comprises a third current source, connected between the emitters of the first and second bipolar transistors, and the ground terminal. The third current source may be configured to sink a current equal to twice that supplied by the second current source plus a current through the second resistor. This may ensure precise matching of the emitter currents of the two bipolar transistors. In passing is it noted that the general term "current source" is used herein to refer to both current sources, stricto senso, and current sinks.

In one or more embodiments the voltage reference is provided directly at the output node. In other embodiments there is provided a second voltage divider comprising two resistors, or resistances, connected between the output node and ground and having a centre node therebetween, wherein the voltage reference (Vref) is at the centre node of the second voltage divider. This allows for scaling of the reference voltage to a particular chosen value or range.

In one or more embodiments the first bipolar transistor and the second bipolar transistor are each NPN transistors.

In one or more embodiments the first bipolar transistor and second bipolar transistor are matched transistors. That is to say, they may be designed to have the same or very similar characteristics. This may ensure that it is straightforward to apply a scaled version voltage from the base emitter voltage of Q2 to the Zener voltage Vz, despite there only being an indirect connection through Q1.

In one or more embodiments the current through the second resistance is less than 100 nA. Using a low current through this voltage divider may ensure that the transistor currents are nearly identical.

In one or more embodiments, the voltage reference circuit is configured to operate with a supply voltage between 6 V and 7 V. This may not be possible in the prior art designs.

In one or more embodiments the second current source and the third current source are each configured to have a zero temperature coefficient, OTC.

In one or more embodiments, the third current source is configured to provide a current consisting of a proportional to absolute temperature, PTAT, component and a CTAT component, wherein the CTAT component is a scaled version of a current through the second resistor.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which.

Figure 1:
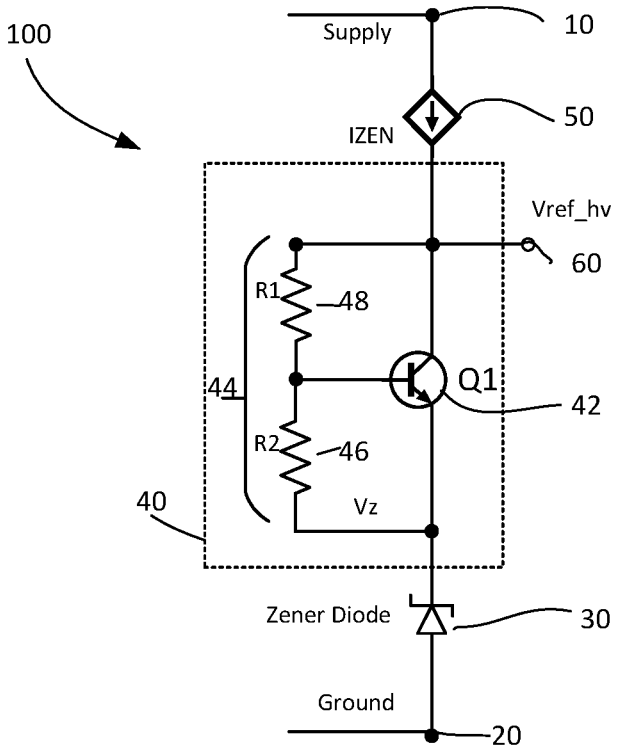
FIG. 1 illustrates conventional voltage reference circuit based on a Zener diode and including temperature compensation.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments

DETAILED DESCRIPTION OF EMBODIMENTS

FIG. 1 illustrates a conventional voltage reference circuit 100 based on a Zener diode and including temperature compensation. Circuit 100 has a supply terminal 10 configured to receive a supply voltage, and a ground terminal 20 configured to operate at a ground voltage. The circuit includes a Zener diode 30, connected in series with a compensation circuit 40 and a current source 50 between the supply and ground. The current source 50 supplies a current IZEN through the Zener diode 30. The voltage Vz across the diode is relatively stable, but as already mentioned, exhibits a positive temperature coefficient. The compensation circuit 40 is therefore provided in series with the Zener diode to add a temperature dependent voltage to the Zener voltage Vz. The compensation for circuit 40 consists of a bipolar transistor Q1 42 connected in parallel with a voltage divider 44 consisting of lower resistor R2 46 and upper resistor R1 48. The base of the bipolar transistor is connected to the centre node of the resistive divisor, that is to say between R2 and R1, while the lower terminal of the voltage divider is connected to the emitter of the bipolar transistor at lower node 55 and the upper terminal of the voltage divider is connected to the collector of the bipolar transistor. The reference voltage Vref_hv at output node 60 is provided at the collector of the bipolar transistor.

From FIG. 1 can be shown that:

$$V\text{ref_}hv = V_z + V_{be1} + V_{R1} \tag{1}$$

where $V_{R1}$ is the voltage across resistor R1, and $Vb_{e1}$ is the emitter-base voltage of bipolar transistor Q1.

By setting the resistances within the voltage divider to be large, the base current can be set sufficiently low as to be negligible, then:

$$V_{R1} \cong \left(\frac{V_{be1}}{R_2}\right) \cdot R_1 \tag{2}$$

From which it can be shown that $$Vref_{hv} = Vz + \left(1 + \frac{R_1}{R_2}\right) V_{be1}. \tag{3}$$

Figure 2:
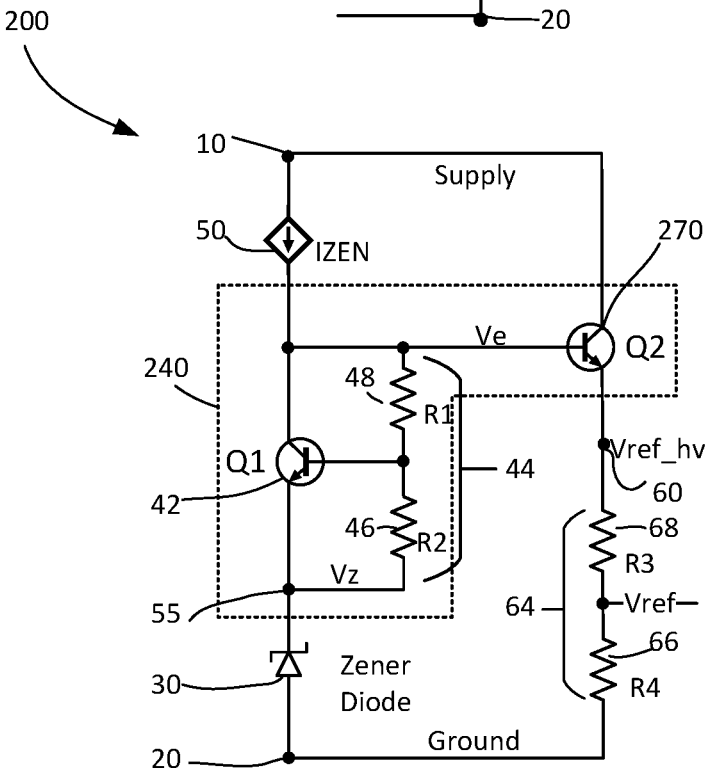
FIG. 2 illustrates an alternative voltage reference circuit based on a Zener diode and including temperature compensation.

Vz has a positive temperature coefficient; however, this is compensated by the negative temperature coefficient of $V_{bet1}$. Since this negative temperature coefficient is approximately −2 mV/° C., is it scaled by a factor (1+R1/R2), where the ratio between R1 and R2 is chosen to cancel out the positive temperature coefficient of Zener diode. It will be appreciated the since (1+R1/R2) is always greater than unity. So. when 0 mV/° C.<TC1_zener<~2 mV/° C., this structure cannot, by itself, make a OTC Vref_hv FIG. 2 illustrates an alternative voltage reference circuit 200 based on a Zener diode and including temperature compensation. This circuit is generally similar to the circuit of FIG. 1 except that the compensation circuit relies on a $V_{be}$ of a second bipolar transistor which decouples the current through the bipolar transistor from the Zener current.

Circuit 200 has a supply terminal 10 configured to receive a supply voltage, and a ground terminal 20 configured to operate at a ground voltage. The circuit includes a Zener diode 30, connected in series with a compensation circuit 240 and a current source IZEN 50 between the supply and ground. The current source 50 supplies a current through the Zener diode 30. The compensation circuit 40 is therefore provided in series with the Zener diode to add a temperature dependence voltage to the Zener voltage Vz. The compensation for circuit 240 consists of a bipolar transistor Q1 42 connected in parallel with a voltage divider 44 consisting of lower resistor R2 46 and upper resistor R1 48. The base of the bipolar transistor is connected to the centre node of the resistive divisor, that is to say between R2 and R1, while the lower terminal of the voltage divider is connected to the emitter of the bipolar transistor, at lower node 55, and the upper terminal of the voltage divider is connected to the collector of the bipolar transistor. This circuit differs from that shown in FIG. 1 in that the collector of Q1 at voltage Ve, is not directly connected as the reference voltage, but is connected to the base terminal of a second bipolar transistor Q2 270. This second bipolar transistor Q2 is connected in a second path between supply 10 and ground 20, in series with a second voltage divider 64 comprising two resistors R4 66 and R3 68 with a node Vref therebetween. The node between the second voltage divider 64 and the emitter of transistor Q2 is denoted Vref_hv. Analysis of this circuit yields:

$$V_{ref} = \left(\frac{R_4}{R_3 + R_4}\right) \cdot \left(V_Z + \left(1 + \frac{R_1}{R_2}\right) V_{be1} - V_{be2}\right) \tag{4}$$

where $V_{be2}$ is the base emitter voltage of Q2. Assuming an identical bias current to each transistor, $V_{be1}$ is equal to $V_{be2}$, and the above equation can be simplified to:

$$V_{ref} = \left(\frac{R_4}{R_3 + R_4}\right) \cdot \left(V_Z + \left(\frac{R_1}{R_2}\right) V_{be1}\right). \tag{5}$$

Thus, this circuit is similar to that of FIG. 1, but instead of an invariant voltage reference Vref_hV, the value of the voltage reference, Vref, can be chosen by suitable choices of the resistors in the second resistive divisor 64.

However, the above analysis relies on the assumption that the base-emitter voltages of Q1 and Q2 are the same. In practice this is not necessarily the case. It would be desirable to provide a circuit in which the base-emitter voltages of Q1 and Q2 can be made equal, or sufficient close that the difference is negligible.

Figure 3:
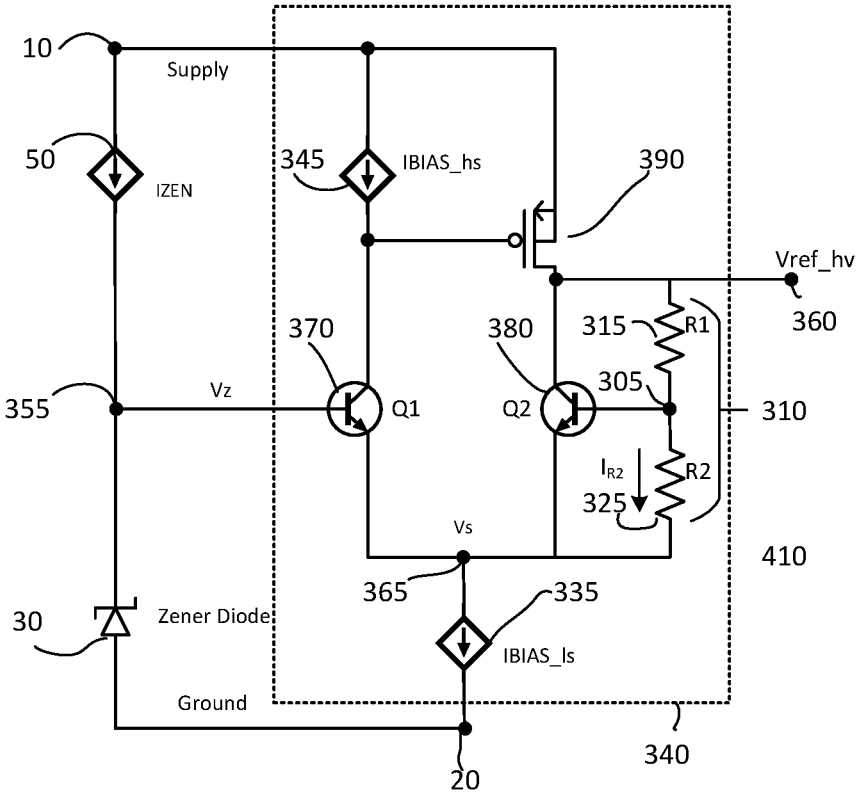
FIG. 3 illustrates a voltage reference circuit based on a Zener diode and including temperature compensation according to one or more embodiments.

FIG. 3 illustrates a voltage reference circuit 300 based on a Zener diode and including temperature compensation according to one or more embodiments. Conceptually, this circuit differs from the circuit shown in FIGS. 1 and 2 in that the compensation circuit is not stacked on top of the diode, and can thus operate at a lower supply voltage.

Circuit 300 has a supply terminal 10 configured to be connected to a supply voltage, and a ground terminal 20 configured to be connected to a ground voltage. The circuit includes a first current source 50 which supplies a current IZEN and a Zener diode 30 connected in series between the supply terminal and the ground terminal. Between the current source 50 and the Zener diode 30 is a first node 355 at which there is a Zener voltage (Vz).

The Zener voltage node having voltage Vz is related to an output node 360, configured to provide a first voltage reference Vref_hv, by a compensation circuit. First voltage reference 360 may also be considered to be a high voltage reference as will become more apparent from the discussion of a lower voltage reference hereinbelow. The compensation circuit takes the form of a complementary to absolute temperature, CTAT, circuit 340 connected between the first node and the output node. That is to say, the voltage difference (between the Zener voltage Vz and the voltage Vref_hv at the output node) decreases as the temperature or absolute temperature increases.

Similarly to the circuit shown in FIG. 2, the CTAT circuit 240 comprises two bipolar transistors Q1 370 and Q2 380. However, in contrast to the circuit shown in FIG. 2, the transistors are arranged to carry similar currents. Thus, in the embodiment shown, the CTAT circuit is based on a first bipolar transistor Q1 370 and a second bipolar transistor Q2 380, each having a base, a collector and an emitter, having their respective emitters connected at a second node 365 at a voltage Vs, and configured to, in operation, have equal, or similar, collector-emitter currents.

The base of the first bipolar transistor is connected to the first, Zener voltage, node and the base of the second bipolar transistor is connected to a centre node 305 of a voltage divider which consists of two resistances or resistors R1 315 and R2 325. The voltage divider is connected between the emitter of the second bipolar transistor and the output node (Vref_hv), that is to say it is connected in parallel with the second bipolar transistor Q2.

Current is supplied to each of the two bipolar transistor 370 Q1 and 380 Q2 by means of two further current sources 335 and 345, (which are separate to the first current source 50 providing the Zener current). In particular, a second current source 345 is connected between the collector of the first bipolar transistor and the supply node, and configured to provide a bias current I_BIAS_hs to the first bipolar transistor. And a third current source 335 is connected between the common emitters of the first and second bipolar transistors and the ground terminal. This current source is configured to sink a current I_BIAS_ls from the pair of transistors. Transistors Q1 and Q2 are arranged in parallel in the sense that they each form part of two separate legs between the node 365 at voltage Vs (that is to say the high side of the first current source 335) and the voltage terminal 10.

The two legs carry similar, or equal, current. Various means to ensure proper current sharing between the two legs will be apparent to the skilled person. In the embodiment depicted in FIG. 3, this is achieved by means of a FET 390. The FET may be a p-channel mode FET. The FET is included in the same leg as the second bipolar transistor, and has its main terminals connected between the collector of the second bipolar transistor and the supply node, and a control terminal connected to the collector of the first bipolar transistor. The FET is configured to match the collector-emitter currents through the first and second legs—that is to say, through the first and second bipolar transistors. (In practice, the current through the second leg is shared between the second bipolar transistor Q2 and the potential divider R1 R2. However, as will be discussed in more detail below, the current through the potential divider R1 R2 is chosen to be several orders of magnitude lower than the current through Q2, and is thus effectively negligible.)

Figure 4:
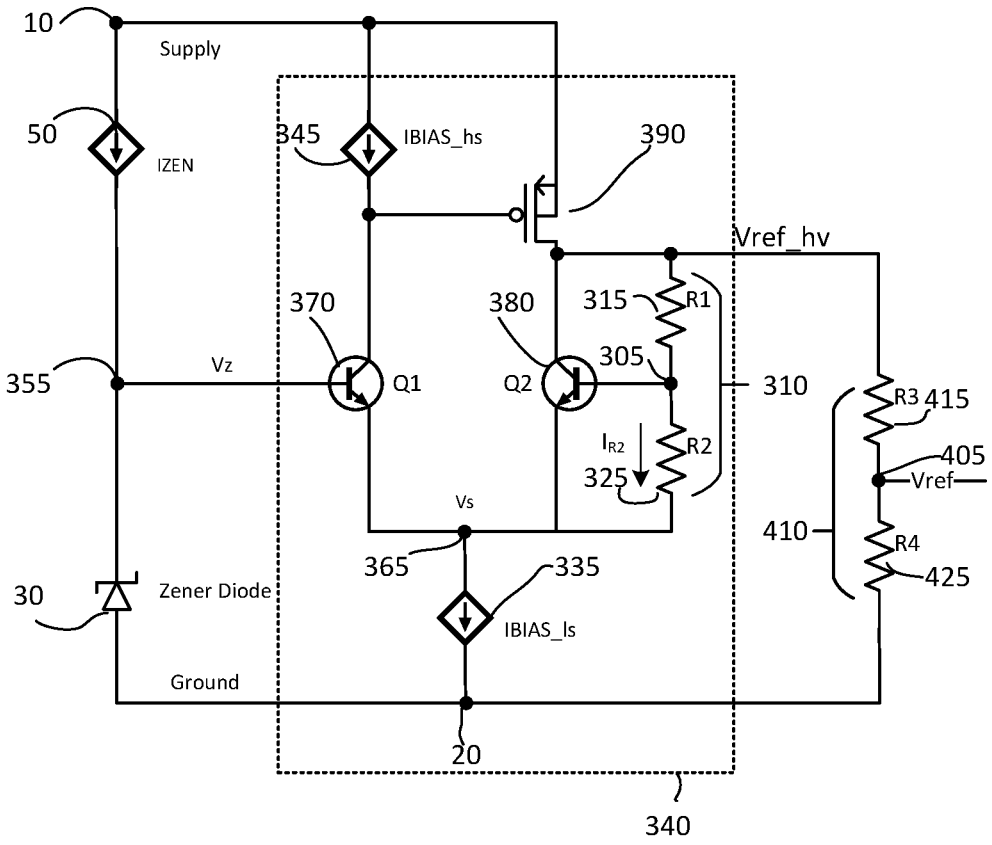
FIG. 4 illustrates a voltage reference circuit based on a Zener diode and including temperature coefficient according to one or more other embodiments.

FIG. 4 illustrates a voltage reference circuit based on a Zener diode and including temperature coefficient correction according to one or more other embodiments of the present disclosure. This circuit is broadly similar to the circuit of FIG. 3: the directly corresponding parts do not need to be described in more detail. However, this circuit has an additional, second, voltage divider 410. This second voltage divider 410 comprises two resistors R3 415 and R4 425 connected between the output node 305 and ground. The second voltage divider has a centre node 405 between the resistors R1 and R2. The voltage reference 405, having voltage Vref, is at the centre node of the second voltage divider. As will be immediately apparent to the skilled person this voltage divider operates to scale the high voltage output reference Vref_hv to the chosen reference voltage Vref.

The circuits of FIG. 3 and FIG. 4 may be analysed as follows:

$$V\mathrm{ref}_{hv}=Vz-V_{be1}+V_{be2}+V_{R1} \quad (5),$$

Where $V_{R1}$ is the voltage across R1 in the first voltage divider.

But since Q1 and Q2 carry near identical currents, $V_{be1}$ and $V_{be2}$ are equal and can be cancelled out. Then $$V\mathrm{ref}_{hv}=Vz+V_{R1} \quad (6).$$

The base current in Q2 can be considered to be negligible, as the values of the resistances R1 and R2 are set to be large. Then $$I_{R1} \cong \frac{V_{be2}}{R_2} + I_{b2} \cong \frac{V_{be2}}{R_2}, \text{ so.} \quad (7)$$

$$V_{R1} \cong \frac{R_1 \cdot V_{be2}}{R_2} \quad (8)$$

Substituting this into equation (6) gives:

$$V_{refhv} = V_Z + \frac{R_1}{R_2} \cdot V_{be2}. \quad (9)$$

And applying the voltage divider discussed above:

$$V_{ref} = \left(\frac{R_4}{R_3 + R_4}\right)\left[V_Z + \frac{R_1}{R_2} \cdot V_{be2}\right]. \quad (10)$$

The above equation shows, firstly (and as already mentioned), that the voltage reference Vref is scalable compared with Vref_hv according to $$\left(\frac{R_4}{R_3 + R_4}\right). \quad (11)$$

And secondly, that the positive temperature coefficient of the Zener voltage, Vz, is compensated by the negative temperature coefficient of the base-emitter voltage of Q2, $V_{be2}$. As the skilled person will be aware, the temperature coefficient of $V_{be2}$ is typically −2 mV/° C. Adjustment of the ratio R1 over R2 then allows for near-perfect cancellation of the positive voltage coefficient of the Zener diode.

In the voltage reference circuit shown in FIG. 2, the supply voltage must be sufficient to provide the sum of the Zener voltage, the collector-emitter voltage of Q1, and the collector-base voltage of Q2. In contrast, embodiments of the present disclosure as shown in FIGS. 3 and 4 may operate with a lower supply voltage. In particular, since the bipolar transistors have commonly-connected emitters, the supply voltage is only required to supply provide sufficient headroom for the Zener voltage, the base-collector voltage of Q1, and any voltage drop required to provide the high-side current source IBIAS_hs 345. Thus embodiments of the present disclosure may be configured to operate with a minimum supply voltage of approximately 6 V, in contrast to previous circuits such as that shown in FIG. 2 which generally require a minimum supply voltage of approximately 7 V.

Figure 5:
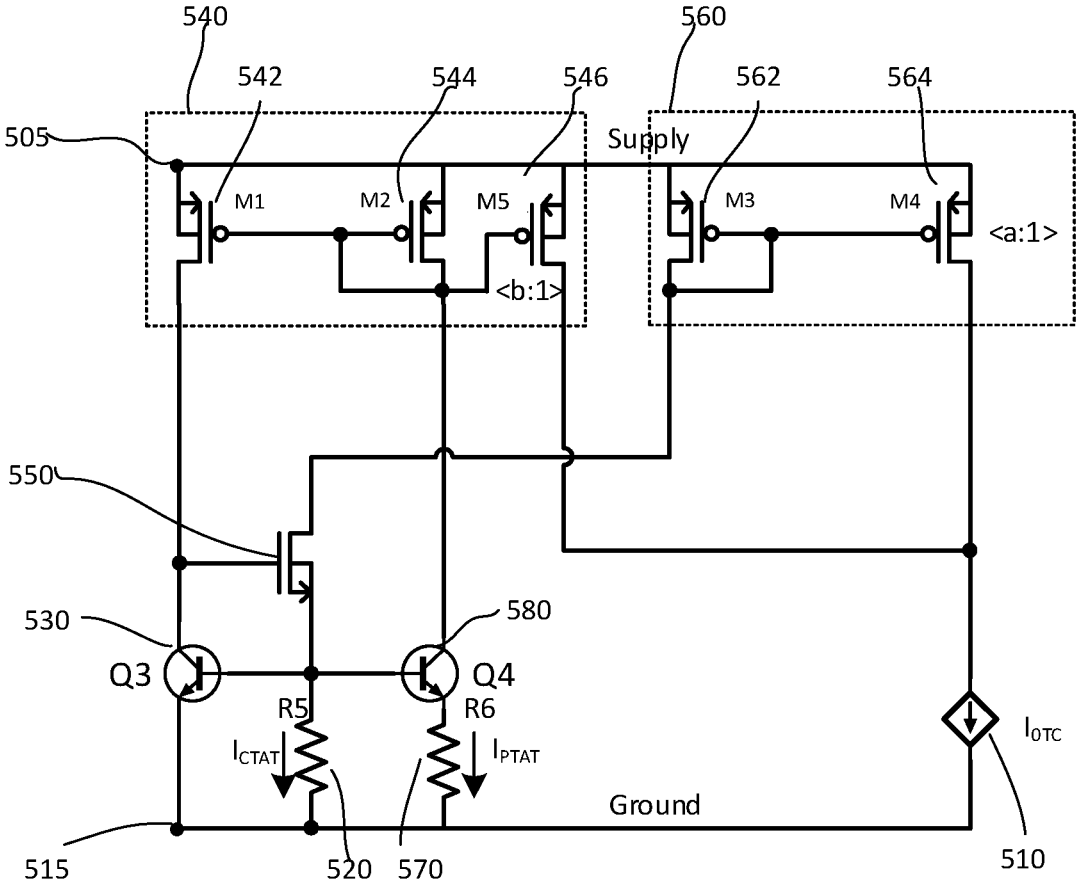
FIG. 5 illustrates a biasing circuit for providing bias currents to embodiments of the present disclosure.

Turning now to FIG. 5, this diagram illustrates a bias circuit 500 for providing bias currents to embodiments of the present disclosure, useing techniques familiar to the skilled person. The bias circuit provides a temperature compensated constant current, Iarc. The temperature compensated constant current lorc may be used, for example, as the current I_BIAS_hs in the high side current source 345. In overview, the temperature compensated constant current is provided as the sum of two currents, which are in turn determined using scaled current mirrors based on a complementary to absolute temperature (CTAT) current $I_{CTAT}$ and a proportional to absolute temperature (PTAT) current IPTAT respectively.

The complementary to absolute temperature current is determined as the current through a resistor R5, 520, connected between the base and emitter of a first NPN bipolar transistor Q3 530. The first NPN bipolar transistor is connected, in series with a first FET M1 542, between a supply voltage 505 and a ground voltage 515. The current through R5 is supplied through a first leg M3 562 of a first scaled current mirror 560. The second leg M4 564 of the scaled current mirror provides this current, scaled by a factor <a:1>, as a first part of the current $I_{0TC}$.

The proportional to absolute temperature current is determined as the current through a second resistor R6, 570, connected between the emitter of a second NPN bipolar transistor Q4 580 and ground. The collector of second NPN bipolar transistor is connected, in series with second FET M2 544 to the supply voltage 505. The second FET M2 544 is in a current mirror configuration 540 with first FET 542. This current mirror 540 includes a further, scaled, copy of the current through a further FET M5 546. This leg provides a copy of the current through R6, scaled by a factor of <b:1>, which is combined with the first scaled factor currents, to provide the second part of the current $I_{0TC}$.

As already mentioned, this temperature compensated current source $I_{0TC}$ may be used directly to provide the current I_BIAS_hs to the high side current source. A similar circuit may be used to supply the current I_bias_Is to the low side bias current source 335. This current should be approximately twice the high side current. In more detail, it should include the current IR2, which as mentioned above may be so low as to be negligible. However, it would be possible to take this into account and to provide an improved accuracy by setting this current to be a scaled version of the complementary to absolute temperature current $I_{CTAT}$ mentioned above, that is to say IR2=c.$I_{CTAT}$.

From reading the present disclosure, other variations and modifications will be apparent to the skilled person. Such variations and modifications may involve equivalent and other features which are already known in the art of then based voltage references and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, and reference signs in the claims shall not be construed as limiting the scope of the claims.

What is claimed is:

1. A voltage reference circuit comprising:

a supply terminal configured to be connected to a supply voltage;

a ground terminal configured to be connected to a ground voltage;

a first current source and a Zener diode connected in series between the supply terminal and the ground terminal and having a first node therebetween and configured to supply a Zener voltage at the first node;

an output node configured to provide a voltage reference; and a complementary to absolute temperature, CTAT, circuit connected between the first node and the output node;

wherein the CTAT circuit comprises:

a first bipolar transistor and a second bipolar transistor, each having a base, a collector and an emitter, having their respective emitters connected at a second node, and configured to, in operation, have equal collector-emitter currents, wherein the base of the first bipolar transistor is connected to the first node and the base of the second bipolar transistor is connected to a centre node of a first voltage divider, and wherein the first voltage divider consists of a first resistance connected between the output node and the centre node and a second resistance connected between the centre node and the emitter of the second bipolar transistor.

2. A voltage reference circuit as claimed in claim 1, wherein the CTAT circuit further comprises a second current source, connected between the collector of the first bipolar transistor and the supply node, and configured to provide a bias current to the first bipolar transistor.

3. A voltage reference circuit as claimed in claim 1, wherein the CTAT circuit further comprises a FET having main terminals connected between the collector of the second bipolar transistor and the supply node, and a control terminal connected to the collector of the first bipolar transistor, and configured to match the collector-emitter currents through the first and second bipolar transistors.

4. A voltage reference circuit as claimed in claim 1, wherein the CTAT circuit further comprises a third current source, connected between the emitters of the first and second bipolar transistors, and the ground terminal.

5. A voltage reference circuit as claimed in claim 1, wherein the third current source is configured to sink a current equal to twice that supplied by the second current source plus a current through the second resistor.

6. A voltage reference circuit as claimed in claim 1, wherein the voltage reference is provided directly at the output node.

7. A voltage reference circuit as claimed in claim 1, further comprising a second voltage divider comprising two resistors connected between the output node and ground and having a centre node therebetween, wherein the voltage reference is at the centre node of the second voltage divider.

8. A voltage reference circuit as claimed in claim 1, wherein the first bipolar transistor and the second bipolar transistor are each NPN transistors.

9. A voltage reference circuit as claimed in claim 1, wherein the first bipolar transistor and second bipolar transistor are matched transistors.

10. A voltage reference circuit as claimed in claim 1, wherein the current through the first voltage divider is less than 100 nA.

11. A voltage reference circuit as claimed in claim 3, configured to operate with a minimum supply voltage which is the sum of the Zener voltage and a gate-source voltage across the FET.

12. A voltage reference circuit as claimed in claim 1, configured to operate with a supply voltage between 6 V and 7 V.

13. A voltage reference circuit as claimed in claim 1, wherein the second current source and the third current source are each configured to have a zero temperature coefficient, OTC.

14. A voltage reference circuit as claimed in claim 4, wherein the third current source is configured to sink a current consisting of a proportional to absolute temperature, PTAT, component and a CTAT component, wherein the CTAT component is a scaled version of a current through the second resistor.

15. A voltage reference circuit as claimed in claim 1, wherein the CTAT circuit further comprises a third current source, connected between the emitters of the first and second bipolar transistors, and the ground terminal.

16. A voltage reference circuit comprising:

a supply terminal configured to be connected to a supply voltage;

a ground terminal configured to be connected to a ground voltage;

a first current source and a Zener diode connected in series between the supply terminal and the ground terminal and having a first node therebetween and configured to supply a Zener voltage;

an output node configured to provide the voltage reference; and a complementary to absolute temperature, CTAT, circuit connected between the first node and the output node;

wherein the CTAT circuit comprises a first bipolar transistor and a second bipolar transistor having matched emitter currents wherein the first bipolar transistor is configured to receive the Zener voltage at its base, and the voltage reference is derived from a voltage at the base of the second bipolar transistor.

17. The voltage reference circuit of claim 16, wherein the first bipolar transistor and the second bipolar transistor, each having a base and a collector and an emitter, with their respective emitters connected at a second node, wherein the collector of the first transistor is connected to the supply terminal by a second current source, the collector of the second transistor is connected to the output node, and to the supply terminal through a FET, and the base of the first bipolar transistor is connected to the first node;

a voltage divider connected in parallel with the second bipolar transistor and having a centre node connected to the base of the second transistor, a lower terminal connected to the second node, and an upper terminal connected to the output node; and a third current source connected between the ground terminal and the second node.

18. The voltage reference circuit of claim 17, further comprising a second voltage divider comprising two resistors connected between the output node and ground and having a centre node therebetween, wherein the voltage reference is at the centre node of the second voltage divider.

19. The voltage reference circuit of claim 18, wherein the CTAT circuit further comprises a second current source, connected between the collector of the first bipolar transistor and the supply node, and configured to provide a bias current to the first bipolar transistor.

20. The voltage reference circuit of claim 18, wherein the CTAT circuit further comprises a third current source, connected between the emitters of the first and second bipolar transistors, and the ground terminal.

* * * * *